US005730806A

United States Patent [19]

Caimi et al.

[11] Patent Number: 5,730,806

[45] Date of Patent: Mar. 24, 1998

[54] GAS-LIQUID SUPERSONIC CLEANING AND CLEANING VERIFICATION SPRAY SYSTEM

[75] Inventors: Raoul E. B. Caimi; Feng-Nan Lin, both of Titusville; Eric A. Thaxton, Merritt Island, all of Fla.

[73] Assignee: The United States of America as represented by the Administrator of the National Aeronautics & Space Administration, Washington, D.C.

[21] Appl. No.: 437,859

[22] Filed: May 8, 1995

Related U.S. Application Data

[63] Continuation of Ser. No. 116,593, Aug. 30, 1993, abandoned.

[51] Int. Cl.[6] ..... B08B 3/02

[52] U.S. Cl. ..... 134/22.12; 134/36; 134/113; 134/102.1; 134/102.2

[58] Field of Search ..... 134/113, 111, 134/102.1, 36, 100.1, 201, 22.12, 22.18, 102.2; 239/433, 346; 261/DIG. 78; 417/172, 171

[56] References Cited

U.S. PATENT DOCUMENTS

| | | | |
|---|---|---|---|
| 2,201,080 | 5/1940 | Clark | 134/102.1 X |
| 2,244,159 | 6/1941 | Hunter | 134/102.1 X |
| 2,366,969 | 1/1945 | Kiggins | 239/433 |
| 2,904,053 | 9/1959 | Henzel | 134/102.1 X |
| 3,188,238 | 6/1965 | Lyon . | |
| 3,701,486 | 10/1972 | Kuhner et al. . | |
| 4,059,123 | 11/1977 | Bartos et al. . | |
| 4,141,754 | 2/1979 | Fravenfeld . | |
| 4,208,213 | 6/1980 | Eischeid | 134/111 X |
| 4,237,565 | 12/1980 | Turita et al. | 134/113 X |
| 4,241,877 | 12/1980 | Hughes | 261/DIG. 78 |
| 4,272,499 | 6/1981 | Cason . | |
| 4,274,812 | 6/1981 | Elvidge et al. . | |
| 4,379,679 | 4/1983 | Guile . | |
| 4,388,045 | 6/1983 | Simon . | |
| 4,545,157 | 10/1985 | Saurwein | 237/433 X |
| 4,690,333 | 9/1987 | Johansson . | |
| 4,787,404 | 11/1988 | Klosterman et al. . | |
| 4,793,556 | 12/1988 | Sharp . | |
| 4,806,171 | 2/1989 | Whitlock et al. | 134/302 |
| 4,826,084 | 5/1989 | Wallace . | |
| 4,867,918 | 9/1989 | Kiyonaga et al. | 261/DIG. 78 |
| 4,909,914 | 3/1990 | Chiba et al. . | |
| 4,919,853 | 4/1990 | Alvarez et al. | 261/78.2 |
| 4,989,787 | 2/1991 | Nikkel et al. | 239/346 |
| 5,029,594 | 7/1991 | Pierce, Jr. . | |
| 5,044,552 | 9/1991 | Becker et al. . | |
| 5,061,406 | 10/1991 | Cheng | 261/DIG. 78 |
| 5,125,126 | 6/1992 | Bonnant . | |
| 5,252,298 | 10/1993 | Jones . | |
| 5,279,357 | 1/1994 | Kennon et al. . | |
| 5,322,571 | 6/1994 | Plummer et al. | 134/102.1 |
| 5,326,228 | 7/1994 | Armitage et al. | 417/158 |
| 5,336,356 | 8/1994 | Ban et al. | 134/102.1 X |
| 5,366,562 | 11/1994 | Schwarze et al. | 134/102.2 |

FOREIGN PATENT DOCUMENTS

| | | | |
|---|---|---|---|
| 2075367 | 11/1981 | United Kingdom | 237/433 |
| 2096911 | 10/1982 | United Kingdom | 261/18.2 |

*Primary Examiner*—Frankie L. Stinson

*Attorney, Agent, or Firm*—Beth A. Vrioni; John G. Mannix

[57] ABSTRACT

A gas-liquid cleaning spray system employs one or more converging-diverging nozzles to accelerate a gas-liquid mixture to a supersonic velocity for cleaning various types of articles, such as mechanical, electrical and fluid components. The gas, such as air or nitrogen, is supplied at high pressure to a nozzle body where it is mixed with cleaning liquid, such as water or liquid detergent, which is supplied to the nozzle body at a relatively low flow rate. Acceleration of the gas-liquid mixture to a supersonic velocity eliminates the need for a high pressure, high flow rate and high volume liquid supply. After the components are contacted with the gas-liquid mixture, the cleaning liquid can be recaptured and analyzed for cleanliness verification of the components.

7 Claims, 2 Drawing Sheets

GAS-LIQUID SUPERSONIC CLEANING AND CLEANING VERIFICATION SPRAY SYSTEM

This application is a continuation of application Ser. No. 08/116,593, filed Aug. 30, 1993 now abandoned.

ORIGIN OF THE INVENTION

The present invention was made by employees of the United States Government and may be manufactured and used by or for the government for government purposes without the payment of any royalties thereon or therefor.

BACKGROUND OF THE INVENTION

1. Field of the Invention

The present invention relates in general to a cleaning spray system which employs a gas-liquid solvent mixture stream that is directed at supersonic velocities onto components or articles that require cleaning or cleanliness verification.

2. Description of the Prior Art

High pressure spray cleaning systems are often employed for cleaning various types of mechanical, electrical and fluid components and other articles. Unfortunately, traditional high pressure cleaning systems use very large quantities of solvents, the disposal of which creates an environmental problem, especially with the use of solvents such as Freon 113 or other CFCs.

Efforts have been made to overcome this problem by making suitable low flow rate cleaning systems which require much less solvent and thereby substantially reduce the solvent waste problem. Unfortunately, most low flow rate systems cannot provide adequate cleaning of the components.

One solution to this problem is disclosed in U.S. Patent No. 4,787,404 to Klosterman et al. This patent discloses a low flow rate-low pressure atomizer device for a component cleaning system wherein a gas is accelerated to substantially sonic velocity and used to break up a cleaning liquid into small droplets, and accelerate these droplets to approximately half the velocity of the gas to create shear stress at the surface of a component to be cleaned. While the device set forth in this patent is a viable alternative to a conventional high pressure cleaning system, it still suffers from a number of drawbacks. For example, the device employs a vertical acceleration tube adjacent the surface of the component to be cleaned which must be maintained in a vertical position in order for the device to operate properly. In addition, the patented device employs Venturi tube injection to atomize the liquid. This arrangement cannot achieve supersonic velocity of the liquid droplets, thereby reducing the device's cleaning potential efficiency.

SUMMARY OF THE INVENTION

The present invention overcomes the deficiencies of prior art cleaning systems by providing a low solvent flow rate liquid cleaning system in which droplets of cleaning liquid are accelerated to supersonic velocities. In the preferred embodiment of the invention, one or more converging-diverging spray nozzles are employed to accelerate a gas-liquid mixture to supersonic velocities. High-pressure gas flows to the one or more nozzles and the cleaning liquid is injected into and mixed with, the gas flow stream through an orifice upstream of the converging-diverging sections of the nozzles. The mixed liquid-gas flow subsequently enters the converging-diverging nozzle or nozzles where it is inherently accelerated to supersonic speeds as a result of the high gas pressure and the converging-diverging nozzle profile. The supersonic gas-liquid stream is then impinged onto components or articles that require cleaning or cleanliness verification. The supersonic velocity imparted to the liquid by the gas flow and the converging-diverging nozzle(s) gives the liquid sufficient momentum at impact to remove contaminants on the surface of the component being cleaned or verified, while simultaneously dissolving the contaminant into the liquid which can then be recaptured for cleanliness verification.

Two key advantages of the present invention over the prior art include the use of minimal amounts of cleaning liquids in a cleaning operation and the use of significantly lower flow rates and pressures than are employed in conventional high pressure cleaning systems. In other words, the present invention makes use of supersonic velocities instead of high pressures to perform the same cleaning task as a conventional high pressure cleaning system, while greatly reducing the quantity of cleaning liquid used.

BRIEF DESCRIPTION OF THE DRAWINGS

The features and advantages of the present invention will become apparent from the following detailed description of a preferred embodiment thereof, taken in conjunction with the accompanying drawings in which.

DETAILED DESCRIPTION OF A PREFERRED EMBODIMENT

Figure 1:
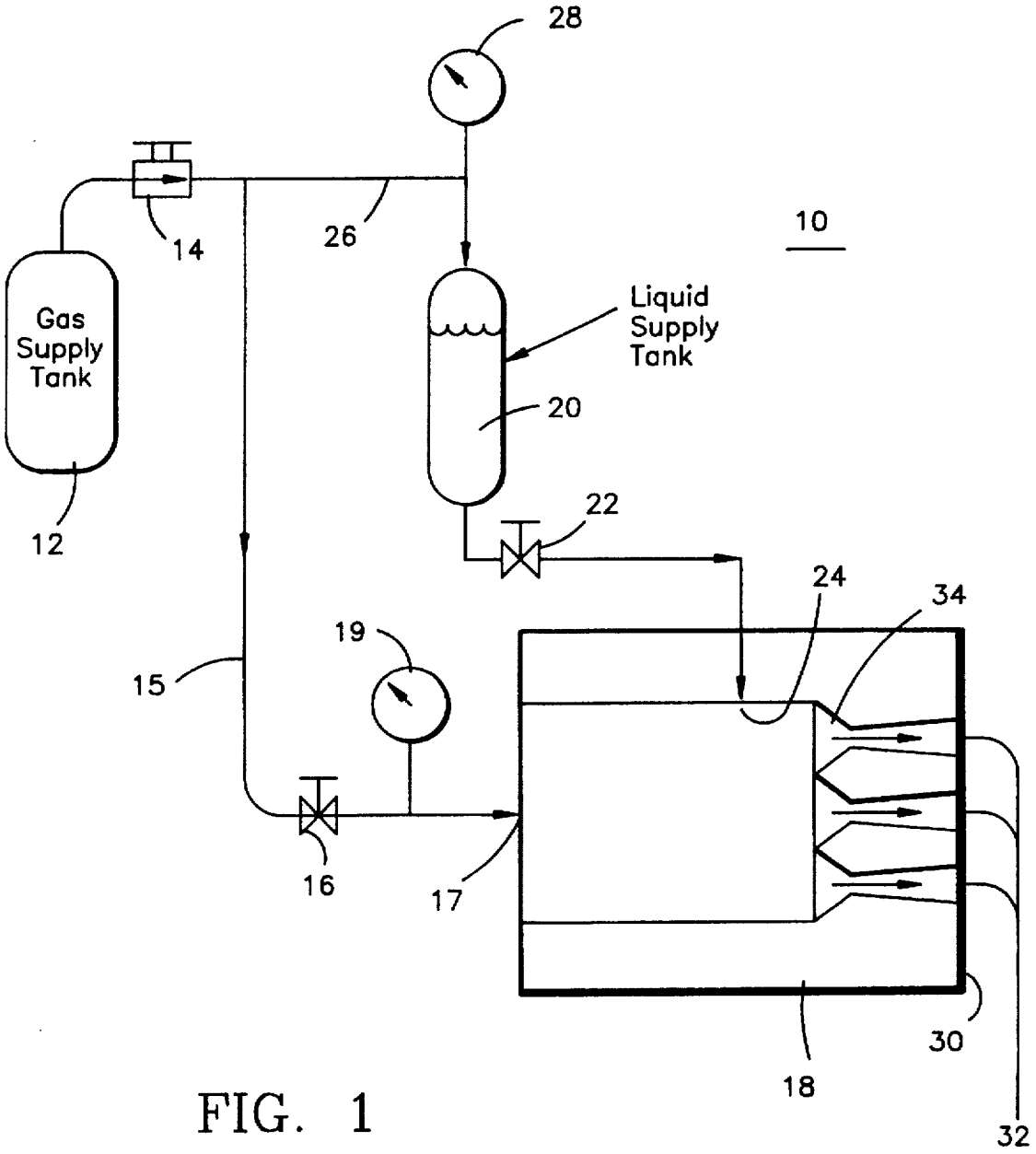
FIG. 1 is a schematic diagram of a cleaning spray system constructed in accordance with a preferred embodiment of the present invention.

Turning now to a more detailed consideration of a preferred embodiment of the present invention, FIG. 1 illustrates a gas-liquid supersonic cleaning spray system 10 in which a high pressure gas is supplied from a gas supply tank 12 through a gas pressure regulator 14, a gas line 15 and a gas supply shutoff and throttling valve 16 to a gas inlet 17 of a nozzle body 18. A first pressure gauge 19 is connected between the valve 16 and nozzle body 18 for monitoring the gas supply pressure. Any suitable gas, such as nitrogen or air, is preferably employed, and is preferably regulated to a pressure of 300 to 500 psi, more or less.

A cleaning liquid, such as water or liquid detergent, is supplied under relatively low pressure from a liquid supply tank 20 through a liquid supply shutoff valve 22 to a liquid inlet orifice 24 disposed in the side of the nozzle body 18. To provide the necessary liquid supply pressure, a gas line 26 is connected between the regulator 14 and the liquid supply 20 so that pressure from the gas supply tank 12 is employed to drive the cleaning liquid out of the liquid supply tank 20. A second pressure gauge 28 is disposed in the line 26 for monitoring the liquid supply pressure.

Figure 3:
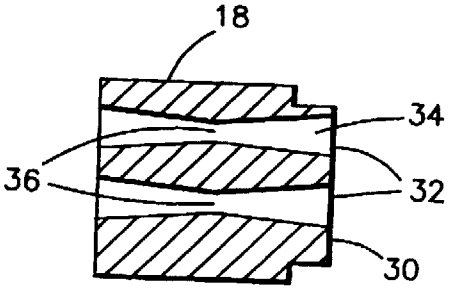
FIG. 3 is a cutaway side view of the nozzle section of the wand of FIG. 2.
Figure 4:
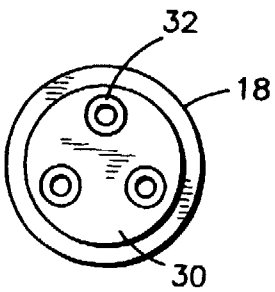
FIG. 4 is an end view of the nozzle of FIG. 3.

Disposed in an outlet end 30 of the nozzle body 18 are one or more converging-diverging spray nozzles 32 as best illustrated in FIGS. 1, 3 and 4. The term "converging-diverging" defines the cross sectional profile of each of the nozzle passages 34 which gradually reduces in diameter to a minimum value at a point 36 as illustrated in FIG. 3, and then expands back to the larger diameter at the outlet end of the nozzle. Although the exact dimensions of the nozzle passages 34 can be selected to be any desired size depending upon the system requirements, as an example, an actual working system was constructed using a three nozzle body, each nozzle having a 0.6 inch passage length, a 7/64 inch inlet and outlet diameter and a 3/64 inch reduced diameter at the point 36 of the passage. The converging-diverging design of the nozzles 32 causes acceleration of the gas-liquid mixture as it passes through the nozzle passages due to the pressure upstream of the nozzles being higher than the ambient pressure. According to conventional gas dynamics principles, to achieve acceleration of the gas-liquid mixture to supersonic velocities, the ratio of the nozzle upstream pressure to the ambient exhaust pressure must be above a certain value. The value is dependent on the particular gas, liquid and mixture ratio being used and, as an example, in one test using a water-air mixture, the value was determined to be 1.86.

Figure 2:
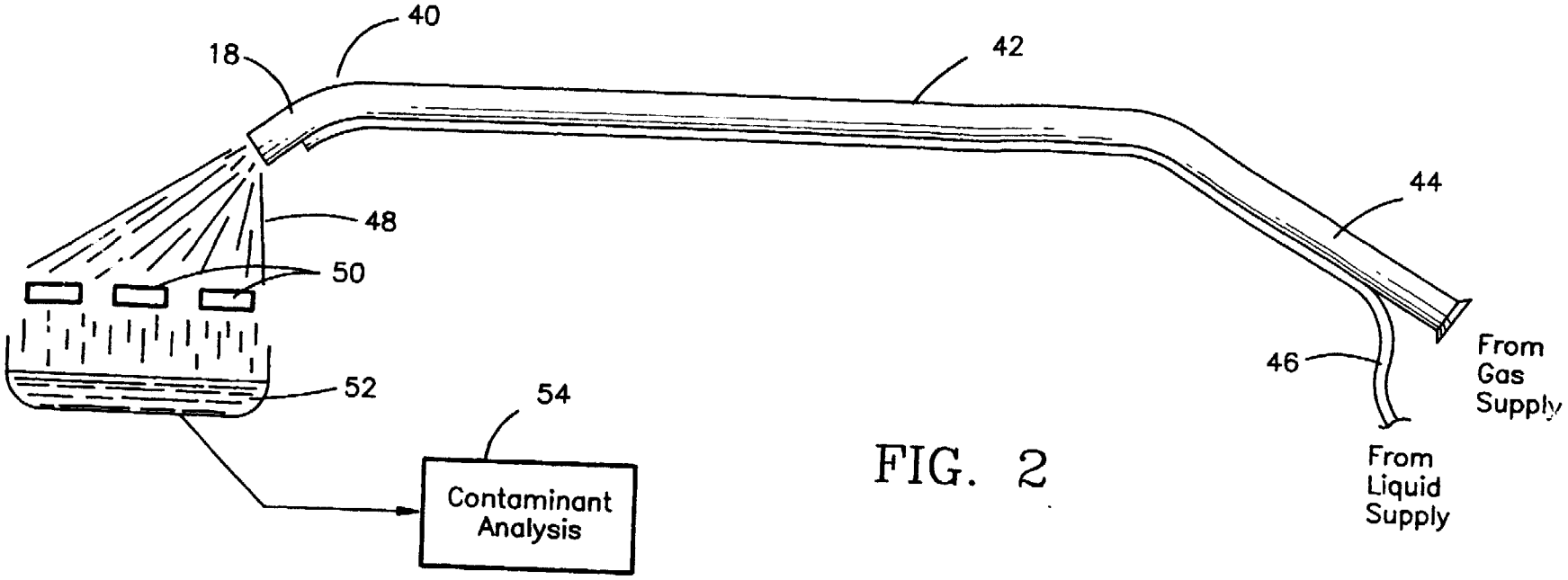
FIG. 2 is a side view of an applicator wand for use with the system of FIG. 1, and schematically shows the wand being used to clean a plurality of components.

As illustrated in FIG. 2, the nozzle body 18 is preferably integrally formed at a nozzle end 40 of a hand-held wand 42. The wand 42 includes a large diameter tube 44 for delivering gas from the gas supply tank 12 to the nozzle body 18, and a smaller diameter tube 46 for supplying cleaning liquid from the liquid supply tank 20 to the nozzle body 18. Although in FIG. 2 the nozzle end 40 of the wand 42 is shown being angled at a 45° angle, any desired angle can be used, depending upon the system requirements, and 45° is shown merely by way of example. FIG. 2 also shows a resulting gas-liquid mixture 48 being ejected from the nozzle end 40 and impinging onto a plurality of components 50 to be cleaned. As schematically illustrated at 52, the cleaning liquid is then recaptured for contaminant analysis and cleanliness verification as indicated at 54.

In the operation of the cleaning system 10, cleaning liquid is supplied to the liquid inlet orifice 24 of the nozzle body 18 at a relatively low flow rate, such as for example, 30 ml/min. As the liquid is injected into the nozzle body 18, it is contacted by and mixed with the high pressure gas. The mixed liquid-gas flow then enters the converging-diverging nozzles 32 where it is inherently accelerated to supersonic speeds. The supersonic gas-liquid stream is then ejected from the nozzles 32 at the nozzle end 40 of the wand 42 where it can be directed onto components or articles that require cleaning or cleanliness verification. The supersonic velocity imparted to the liquid by the gas flow and nozzle profile gives the liquid sufficient momentum at impact to remove contaminants on the surface of the component being cleaned or verified while simultaneously dissolving the contaminant into the liquid, which can then be captured for cleanliness verification.

By recapturing the cleaning liquid after it impinges the components to be cleaned and then analyzing the composition of the cleaning liquid, the cleanliness of the components can be easily verified. Numerous experiments were conducted to determine the cleaning efficiency of the system 10 in this manner. For example, a number of plates were contaminated with a "witch's brew" comprised of 11 different greases. The plates were then cleaned for two minutes each using the cleaning system 10 in which water supplied at 30 ml/min to the liquid inlet orifice 24 was used as the cleaning liquid, and nitrogen supplied at 300 psi was used to mix with the water and drive it through the converging-diverging spray nozzles 32. With this arrangement, over 90% of the grease was removed from the plates after two minutes of cleaning, thus verifying that the system 10 works well even with plain water at a relatively low flow rate.

Using the same procedure, the system 10 can also be employed to verify the cleanliness of components which are already technically "clean". This is accomplished simply by contacting the "clean" components with the gas-liquid mixture, recapturing the cleaning liquid and then analyzing it for contamination levels to determine if the components are in fact acceptably clean.

Although the invention has been disclosed in terms of a preferred embodiment, it will be understood that numerous variations and modifications could be made thereto without departing from the scope of the invention as set forth in the following claims. For example, the flow parameters for the nozzles 32 can be set in any desired manner so that virtually any gas and liquid may be used for a desired flow and mixing ratio. In addition, the size and number of nozzles are clearly adjustable. This adjustability makes it possible to create small hand-held cleaning nozzles as discussed above all the way up to very large multiple nozzle configurations.

What is claimed is:

1. A cleaning spray system comprising:

a) gas supply means for supplying gas at a high pressure;

b) liquid supply means for supplying cleaning liquid at a low flow rate;

c) means to mix gas supplied from said gas supply means and liquid supplied from said liquid supply means to form a gas-liquid mixture; and d) at least one converging-diverging spray nozzle for accelerating said gas-liquid mixture to a supersonic velocity and directing said mixture toward at least one article to be cleaned, said at least one converging-diverging spray nozzle having an inlet end, an outlet end and a nozzle passage connecting said inlet and outlet ends, said nozzle passage having a cross sectional profile which gradually reduces in diameter from said inlet end to a point between said inlet end and said outlet end, and then gradually expands back to a larger diameter at said outlet end.

2. The system of claim 1, wherein said means to mix comprises (a nozzle body of said converging-diverging nozzle, said nozzle body including) a liquid inlet orifice in communication with said liquid supply means and a gas inlet in communication with said supply means.

3. The system of claim 1, wherein said at least one converging-diverging spray nozzle is disposed at an end of a hand-held wand.

4. The system of claim 1, wherein said high pressure gas is supplied at a pressure in the range of approximately 300 to 500 psi.

5. The system of claim 1, wherein said cleaning liquid is chosen from the group comprising water and liquid detergent, and said gas is selected from the group comprising air and nitrogen.

6. A process for cleaning articles, including electrical, mechanical and fluid components, comprising the steps of:

a) mixing a high pressure gas with a low flow rate cleaning liquid to form a gas-liquid mixture;

b) accelerating said gas-liquid mixture to a supersonic velocity by directing said gas-liquid mixture through at least one converging-diverging spray nozzle, said spray nozzle including an inlet end, an outlet end and a nozzle passage connecting said inlet and outlet ends, said nozzle passage having a cross sectional profile which gradually reduces in diameter from said inlet end to a point between said inlet end and said outlet end, and then gradually expands back to a larger diameter at said outlet end; and c) impinging the accelerated gas-liquid mixture onto at least one article to be cleaned.

7. The process of claim 6, further comprising the steps of:

d) recapturing the cleaning liquid after it has contacted the article to be cleaned; and, e) analyzing the recaptured cleaning liquid to verify the cleanliness of the article to be cleaned.

* * * * *